US006764027B2

(12) United States Patent
Dantes et al.

(10) Patent No.: US 6,764,027 B2
(45) Date of Patent: Jul. 20, 2004

(54) FUEL INJECTION VALVE

(75) Inventors: Guenter Dantes, Eberdingen (DE); Detlef Nowak, Untergruppenbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/149,726

(22) PCT Filed: Oct. 15, 2001

(86) PCT No.: PCT/DE01/03913

§ 371 (c)(1),
(2), (4) Date: Sep. 24, 2002

(87) PCT Pub. No.: WO02/31352

PCT Pub. Date: Apr. 18, 2002

(65) Prior Publication Data

US 2003/0047623 A1 Mar. 13, 2003

(30) Foreign Application Priority Data

Oct. 13, 2000 (DE) ..... 100 50 752

(51) Int. Cl.[7] ..... F02M 61/00; F02M 59/00; F02M 63/00; F02M 61/20; B05B 1/34

(52) U.S. Cl. ..... 239/533.12; 239/533.2; 239/533.9; 239/585.1; 239/489

(58) Field of Search ..... 239/533.12, 533.2, 239/533.9, 585.1, 489, 88–92, 533.3, 533.11, 533.14, 585.2, 585.3, 585.4, 585.5

(56) References Cited

U.S. PATENT DOCUMENTS

| | | | | | |
|---|---|---|---|---|---|
| 4,708,289 | A | * | 11/1987 | Szablewski et al. | 239/125 |
| 4,721,253 | A | * | 1/1988 | Noguchi et al. | 239/464 |
| 5,288,025 | A | * | 2/1994 | Cerny | 239/533.8 |
| 5,979,801 | A | | 11/1999 | Munezane et al. | |
| 6,042,028 | A | * | 3/2000 | Xu | 239/585.1 |
| 6,047,905 | A | * | 4/2000 | Honda et al. | 239/533.2 |

FOREIGN PATENT DOCUMENTS

| | | |
|---|---|---|
| DE | 41 31 499 | 4/1993 |
| DE | 42 31 448 | 10/1993 |
| DE | 199 07 860 | 3/2000 |
| EP | 1 026 393 | 8/2000 |
| EP | 1 036 933 | 9/2000 |
| GB | 2 170 269 | 7/1986 |

* cited by examiner

*Primary Examiner*—Michael Mar
*Assistant Examiner*—Darren Gorman
(74) *Attorney, Agent, or Firm*—Kenyon & Kenyon

(57) ABSTRACT

A fuel injector for fuel injection systems of internal combustion engines includes a valve needle and a valve-closure member mechanically linked to it, which cooperates with a valve-seat surface situated in a valve-seat member to form a sealing seat, and at least one swirl-producing element which is situated upstream from the sealing seat in the valve-seat member. One or more swirl channels which are open toward the upstream side of the valve-seat member are incorporated into the upstream side of the valve-seat member as a swirl-producing element.

8 Claims, 2 Drawing Sheets

FUEL INJECTION VALVE

FIELD OF THE INVENTION

The present invention relates to a fuel injector.

BACKGROUND INFORMATION

Fuel injectors in which swirl-producing elements are incorporated into a valve-seat member are referred to in German Patent No. 41 31 499. The swirl-producing element is implemented in the form of grooves which are incorporated into the valve-seat member and discharge into an injection orifice. The metering of the volume of fuel to be injected is accomplished by the cross section of the injection orifice. The injection orifice is located either in the valve-seat member or in a perforated disk which is situated at the downstream end of the fuel injector.

An additional fuel injector in which the swirl is produced by grooves is referred to in German Patent No. 42 31 448. The swirl-producing elements are located upstream from the sealing seat and are incorporated in the form of grooves in a central recess of the valve-seat member which is used to guide the valve-closure member. The swirl grooves, which are open toward the center line of the fuel injector, are closed by the valve-closure member, which is spherical, to form channels. This defines a cross section within the swirl channels through which the fuel is metered.

One disadvantage of the fuel injector referred to in German Patent No. 41 31 499 is the position of the swirl-creating element downstream from the sealing seat. The danger of contamination from coking is great, especially in the case of directly injecting fuel injectors. Particular attention must paid in the configuration to ruggedness of the swirl-producing elements; this limits the configuration options for the component, since minimum requirements for material thickness for example must be adhered to.

A further disadvantage is that the location downstream from the sealing seat causes a dead volume to be formed, from which fuel may escape after the injection operation ends. This afterdripping results in incomplete and uncontrolled combustion, which produces a large amount of pollutants. In addition, the one-piece configuration of nozzle body and valve-seat member makes it difficult to produce the grooves. Exceeding of component tolerances which may occur during manufacturing thus result in the rejection of an expensive component.

In the fuel injector referred to in German Patent No. 42 31 448, completing the grooves into swirl channels by the spherical valve-closure member is disadvantageous. The spherical geometry of the valve-closure member causes the swirl grooves to be closed to form swirl channels only at the circumference of the valve-closure member. This makes it difficult to prevent leakage, since the tolerances of several components are cumulative. This is particularly critically apparent because the sealing gap is in the form of a line. The result is a wide range of variation in the metered fuel volume.

Also disadvantageous is the necessary strong deflection of the fuel stream. This results from the arrangement of the swirl channels on the cylindrical wall of the recess which guides the valve-closure member. The adjacent swirl chamber is necessary to produce a uniformly turbulent stream. However, the associated deflection of the stream leads to severe losses of flow, which are evident in a poorer injection pattern. In addition, during the process of opening the fuel injector a pre-jet is formed, which includes no swirl. The resulting poor atomization causes deficient combustion.

SUMMARY OF THE INVENTION

The exemplary fuel injector according to the present invention may provide that the swirling fuel stream reaches the injection orifice without strong deflection. At the same time the swirl-producing elements are in a protected arrangement upstream from the sealing seat. The separation of the swirl production from the metering of the fuel to be injected is a further advantage for manufacturing. Relatively rough dimensional tolerances may be chosen for the swirl-producing elements, this may allow the use of more economical production methods.

Adaptation of the fuel injector to customer requirements in regard to the volume of fuel to be injected and injection pattern is simple. This is done by modifying only one component, which is able to influence both the swirl production and fuel metering. The swirl production may be varied by influencing the axial component of the fuel stream. This results in modification of the envelope of the cone on which the fuel is injected.

The metered volume is also adjusted while retaining the valve-seat member unchanged, by modifying an annular gap which is produced by an offset in the valve-closure member. In addition to the definition of a metered volume with the fuel injector completely open, the opening and closing response may be influenced by modifying the contour of the offset.

A further advantage is an arrangement of the swirl channels on a cone envelope whose angle is identical to the angle of the valve seat surface. Because of the resulting elimination of strong flow deflection downstream from the production of the swirl there is no loss in circumferential speed of the fuel on the way to the injection orifice.

This results in the further advantage of the elimination of a dead volume downstream from the production of swirl. Consequently a swirl is formed in the fuel stream as early as during the process of opening the fuel injector. In the final analysis, the improved swirl conditioning during opening and closing ensures improved combustion and thus results in lower emission of pollutants.

DETAILED DESCRIPTION

Figure 1:
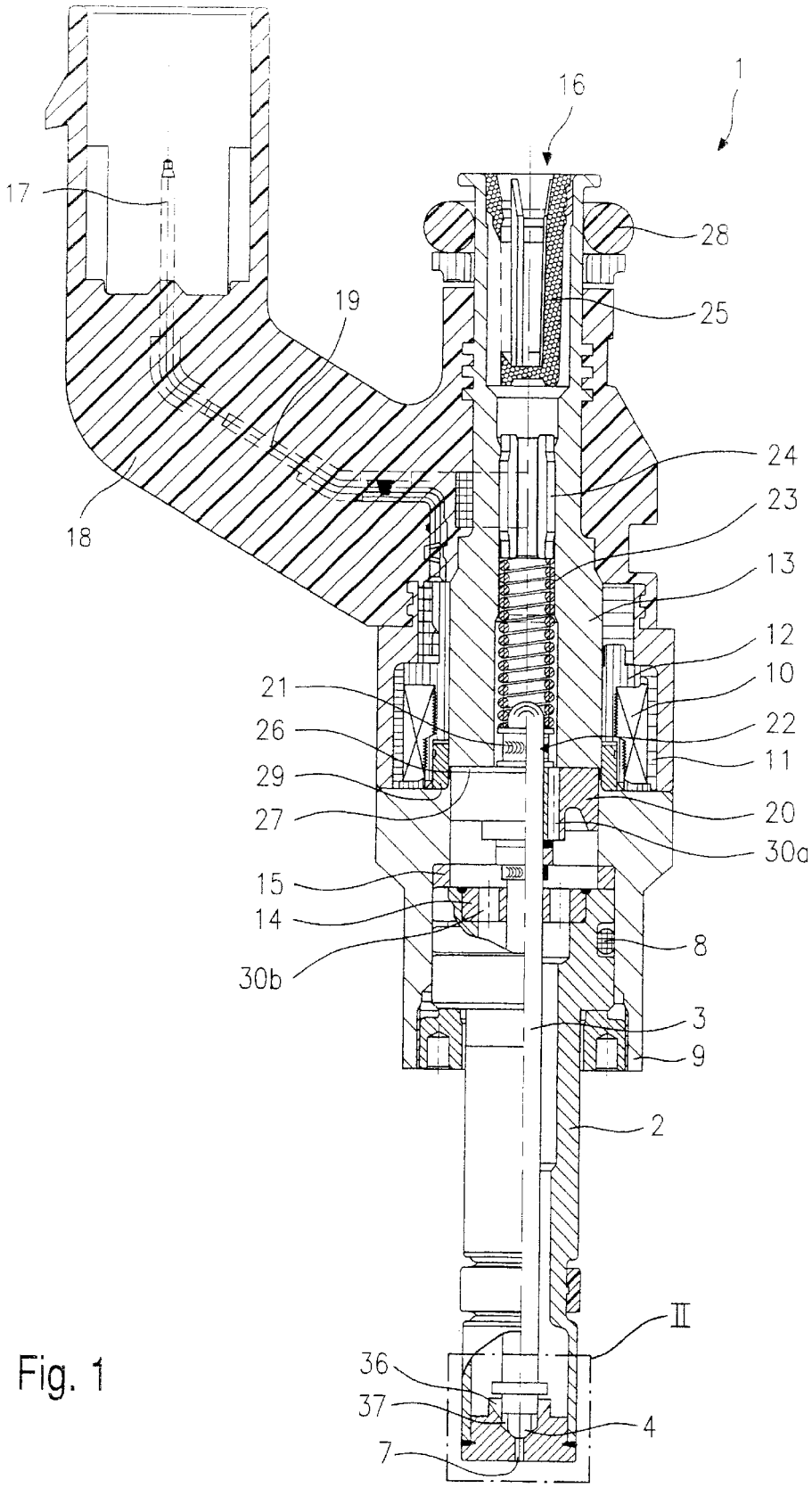
FIG. 1 shows a schematic partial section through an exemplary embodiment of a fuel injector according to the present invention.

Before discussing an exemplary embodiment of a fuel injector 1 according to the present invention with reference to FIGS. 2 and 3, the essential components of the exemplary fuel injector 1 according to the present invention will now be explained briefly in an overall view for a better understanding of the presentation with reference to FIG. 1.

Fuel injector 1 is configured in the form of a fuel injector 1 for fuel injection systems of engines having fuel mixture compression and spark ignition. Fuel injector 1 is suitable in particular for direct injection of fuel into the combustion chamber (not shown) of an engine.

Fuel injector 1 includes a nozzle body 2 in which a valve needle 3 is situated. Valve needle 3 is mechanically linked to a valve-closure member 4, which cooperates with a valve-seat surface 6 on a valve-seat member 5 to form a sealing seat. In this exemplary embodiment, fuel injector 1 is an electromagnetically operated fuel injector 1 which includes an injection orifice 7. Nozzle body 2 is sealed by a gasket 8 from a stationary pole 9 of a solenoid 10. Solenoid 10 is encapsulated in a coil housing 11 and wound onto a field spool 12, which is in contact with an internal pole 13 of solenoid 10. Internal pole 13 and stationary pole 9 are separated from one another by a gap 26 and are supported on a connecting component 29. Solenoid 10 is energized by an electric current that may be supplied through an electric plug-in contact 17 via a line 19. Plug-in contact 17 is enclosed by plastic sheathing 18, which may be integrally molded on internal pole 13.

Valve needle 3 is guided in a disk-shaped valve needle guide 14. Matched to the latter is an adjusting disk 15 which is used to adjust the lift of the valve needle. An armature 20 is situated on the upstream side of adjusting disk 15. Via a flange 21, the armature is frictionally engaged with valve needle 3, which is joined by a weld 22 to flange 21. A restoring spring 23, which is pre-stressed by a sleeve 24 pressed into internal pole 13 in the present configuration of fuel injector 1, is supported on flange 21.

Fuel channels 30*a*, 30*b* run in valve needle guide 14 and armature 20. A filter element 25 is provided in a central fuel feed 16. Fuel injector 1 is sealed from a fuel line (not shown) by a gasket 28.

In the resting state of fuel injector 1, armature 20 is acted upon by restoring spring 23 via flange 21 on valve needle 3 against its direction of lift, so that valve-closure member 4 is held in sealing contact on valve seat 6. When solenoid 10 is energized, it builds up a magnetic field which moves armature 20 in the direction of lift against the elastic force of restoring spring 23, the lift being predetermined by a working gap 27 between internal pole 13 and armature 20 in the resting position. Armature 20 also entrains flange 21, which is welded to valve needle 3, and with it valve needle 3, in the direction of lift. Valve-closure member 4, which is connected to valve needle 3, is lifted up from valve-seat surface 6, and the fuel conveyed through swirl channels 36 and an adjacent annular gap 37 to injection orifice 7 is injected.

When the coil current is turned off, armature 20 drops back due to the pressure of restoring spring 23 onto flange 21 of internal pole 13, so that valve needle 3 moves against the direction of lift. That causes valve-closure member 4 to drop onto valve-seat surface 6, and fuel injector 1 is closed.

Figure 2:
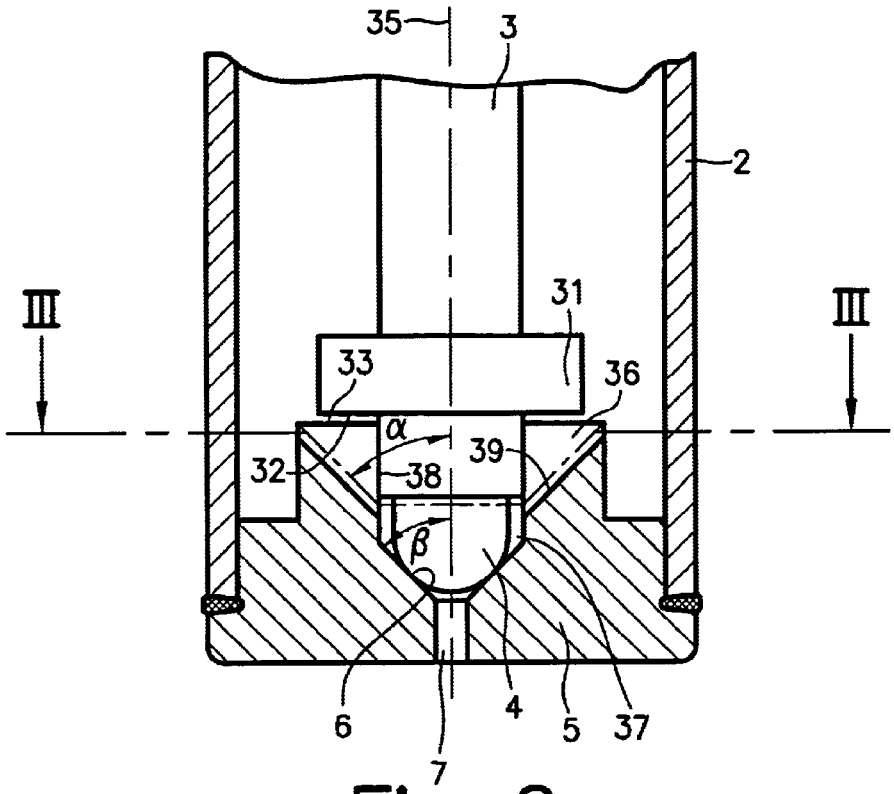
FIG. 2 shows a schematic partial section in detail II of FIG. 1 of the exemplary embodiment of a fuel injector according to the present invention.

FIG. 2 shows the swirl-producing module of an exemplary fuel injector 1 according to the present invention in a sectional detail. The swirl-producing module is made of valve-seat member 5, valve needle 3 and valve-closure member 4, which is mechanically linked to valve needle 3.

On its upstream side 33, valve-seat member 5 includes a guide recess 38 which is used to guide valve needle 3 in the axial direction. Adjacent to it downstream is a tapering, which is cone-shaped, on which valve-seat surface 6 is situated. Adjacent to the narrowing on the downstream side is injection orifice 7. On the upstream side 33 of valve-seat member 5, swirl channels 36 are incorporated into valve-seat member 5. They are open toward the upstream surface 33 of valve body 5, and discharge, e.g., tangentially, into guide recess 38. The swirl channels are configured as grooves in valve-seat member 5. Bottom 39 of the grooves forms the downstream limiting surface of swirl channels 36, and is situated on the envelope of a cone whose apex angle $\alpha$ is identical to apex angle $\beta$ enclosed by cone-shaped valve-seat surface 6 with center line 35 of fuel injector 1.

Upstream from upstream face 33 of valve-seat member 5, valve needle 3 includes a radial extension 31, so that swirl channels 36, which are open on the upstream side, are at least partly covered in the radial direction. Depending on the radial dimension of radial extension 31 and on the distance from upstream face 32 of radial extension 31 to upstream face 33 of valve-seat member 5, the axial component of the fuel stream may thus be varied when fuel injector 1 is open. The dimension of radial extension 31 is smaller than the inside diameter of nozzle body 2. The changes in the axial components of the fuel stream during opening and closing of fuel injector 1 may be influenced selectively for example by a cone-shaped or funnel-shaped configuration of upstream face 33 of valve-seat member 5. It may also be influenced via the corresponding face 32 of radial extension 31.

Valve-closure member 4, which is connected to valve needle 3, includes a radial extension which is smaller than guide recess 38 of valve-seat member 5. The cross sectional area of annular gap 37 thus formed between valve-closure member 4 and valve-seat member 5 determines the metering of the fuel to be injected. The height of annular gap 37 established by valve needle 3 should be chosen such that swirl channels 36 are in contact with annular gap 37, at least when fuel injector 1 is open. If valve needle 3 together with valve-closure member 4 are in their open stop position when solenoid 10 is energized, the cross sectional area of annular gap 37 is the smallest cross section through which the fuel stream must flow on the way to injection orifice 7.

Figure 3:
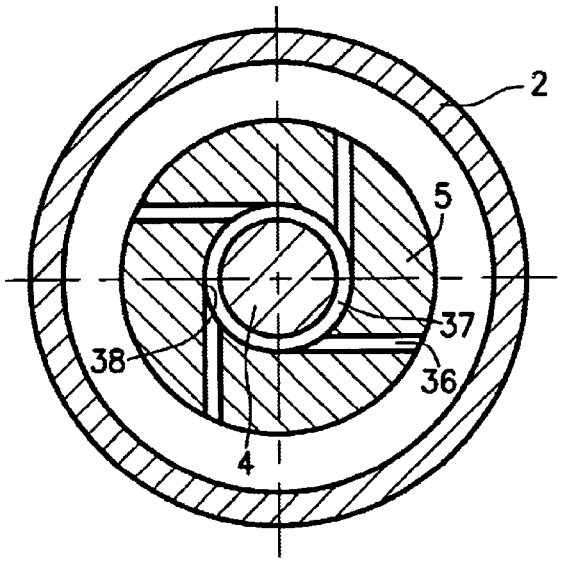
FIG. 3 shows a schematic section along the line III—III in FIG. 2.

FIG. 3 shows a sectional detail of the exemplary embodiment of a fuel injector according to the present invention shown in FIG. 2. Here swirl channels 36 discharge tangentially into annular gap 37, which is formed between valve-closure member 4 and guide recess 38 of valve-seat member 5. The sum of the cross sectional areas of the discharge holes of swirl channels 36 is greater than the cross sectional area of annular gap 37 formed between guide recess 38 of valve-seat member 5 and valve-closure member 4. The cross sectional areas of the discharge holes may be adjusted by increasing the axial dimension of valve-closure member 4 in the area of annular gap 37.

What is claimed is:

1. A fuel injector for a fuel injection system of an internal combustion engine, comprising:

a valve needle;

a valve-seat member;

a valve-seat surface arranged in the valve-seat member;

a valve-closure member connected to the valve needle, the valve-closure member cooperating with the valve-seat surface to form a sealing seat; and at least one swirl-producing element positioned upstream from the sealing seat in the valve-seat member;

wherein at least one swirl channel is open toward an upstream side of the valve-seat member, and is incorporated into the upstream side of the valve-seat member; and wherein the at least one swirl channel includes a groove-incorporated into the valve-seat member, and is open toward the upstream side.

2. The fuel injector of claim 1, wherein the valve needle includes a radial extension upstream from the upstream side of the valve-seat member.

3. The fuel injector of claim 2, wherein the radial extension has a geometry on its upstream side corresponding to the upstream side of the valve-seat member.

4. The fuel injector of claim 1, wherein the valve-closure member includes a radial extension that is smaller than another radial extension of the valve needle.

5. The fuel injector of claim 1, wherein an annular gap is formed downstream from the at least one swirl channel between the valve-closure member and a recess in the valve-seat member, a cross-sectional area of the annular gap forming a smallest cross-sectional area through which fuel flows.

6. The fuel injector of claim 5, wherein the annular gap separates the sealing seat from the at least one swirl channel.

7. The fuel injector of claim 1, wherein a bottom of the at least one swirl channel faces away from the upstream side, and lies on a first conical surface.

8. The fuel injector of claim 7, wherein the valve-seat surface forms a second conical surface and a first apex angle of the first conical surface essentially matches a second apex angle of the second conical surface, the first apex angle and the second apex angle being with respect to a center line of the fuel injector.

* * * * *